United States Patent [19]

Gagliardo

[11] 4,342,426

[45] Aug. 3, 1982

[54] NOZZLE

[75] Inventor: John P. Gagliardo, Shrewsbury, Mass.

[73] Assignee: Feecon Corporation, Westboro, Mass.

[21] Appl. No.: 190,424

[22] Filed: Sep. 24, 1980

[51] Int. Cl.[3] ..... B05B 1/32

[52] U.S. Cl. ..... 239/457

[58] Field of Search ..... 239/451, 460, 456–458

[56] References Cited

U.S. PATENT DOCUMENTS

| | | | |
|---|---|---|---|
| Re. 29,717 | 8/1978 | Thompson | 239/107 |
| 2,186,680 | 12/1957 | Russell | 299/136 |
| 2,883,117 | 4/1959 | Nelson | 239/459 |
| 2,991,016 | 7/1961 | Allenbaugh, Jr. | 239/458 |
| 3,150,829 | 9/1964 | Spech et al. | 239/458 X |
| 3,206,126 | 9/1965 | Thompson | 239/458 X |
| 3,244,376 | 4/1966 | Thompson | 239/458 |
| 3,363,842 | 1/1968 | Burns | 239/441 |
| 3,387,791 | 6/1968 | Allenbaugh, Jr. | 239/458 |
| 3,494,561 | 2/1970 | Buehler | 239/458 |
| 3,539,112 | 11/1970 | Thompson | 239/452 |
| 3,540,657 | 11/1970 | Thompson | 239/458 |
| 3,554,452 | 1/1971 | Davidson et al. | 239/456 |

*Primary Examiner*—Andres Kashnikow

*Attorney, Agent, or Firm*—Blodgett and Blodgett

[57] ABSTRACT

Nozzle for use with a non-aspirated fire-fighting medium capable of a selection of two rates of flow and two modes of spray control.

7 Claims, 3 Drawing Figures

HIGH FLOW

LOW FLOW

NOZZLE

BACKGROUND OF THE INVENTION

In the operation of fire fighting equipment, it is desirable to have available a nozzle for use with a non-aspirating liquid that is capable of operating with a selected one of two considerably different flow rates, while at the same time allowing a selection between a spray and a solid stream of the fluid. Because of the extreme flow rates and the forces that are used in fire fighting, the normal methods of controlling these factors in applications (such as are used in a garden hose and the like) are not appropriate. In the past, nozzles that were capable of these necessary functions have been expensive to manufacture. Also, they have been quite complicated and, therefore, liable to become broken or out of adjustment. These and other difficulties experienced with the prior art devices have been obviated in a novel manner by the present invention.

It is, therefore, an outstanding object of the invention to provide a nozzle capable of operating at two distinct flow rates and with two modes of spray quality.

Another object of this invention is the provision of a multiple function nozzle which is simple and rugged in construction.

A further object of the present invention is the provision of a nozzle which is inexpensive to manufacture and which is capable of a long life of useful service with a minimum of maintenance.

It is another object of the instant invention to provide a nozzle that gives a wide range of control of flow rate without introducing a large amount of resistance to flow.

With these and other objects in view, as will be apparent to those skilled in the art, the invention resides in the combination of parts set forth in the specification and covered by the claims appended hereto.

SUMMARY OF THE INVENTION

In general, the present invention consists of a nozzle intended for use with a non-aspirating fire-fighting medium. It includes a fixed assembly, which has a tubular housing, and a button. The assembly has a cylindrical surface and the housing and the button are concentric with the axis of the cylindrical surface. A first sleeve is mounted concentric with and slidable on the cylindrical surface; it is movable relative to the housing to regulate a control gap. A second sleeve is concentric with the cylindrical surface and is movable relative to the button to control spray.

More specifically, the first sleeve is threadedly engaged with the housing and is movable axially by rotation thereof. The control gap existing between the first sleeve and the button are, therefore, adjusted by the movement of the first sleeve. The first sleeve is provided with a cylindrical bore that extends coaxially of the said cylindrical surface and merges at one end with a conical counterbore facing toward the button. The control gap exists between the button and the surface of the counterbore.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
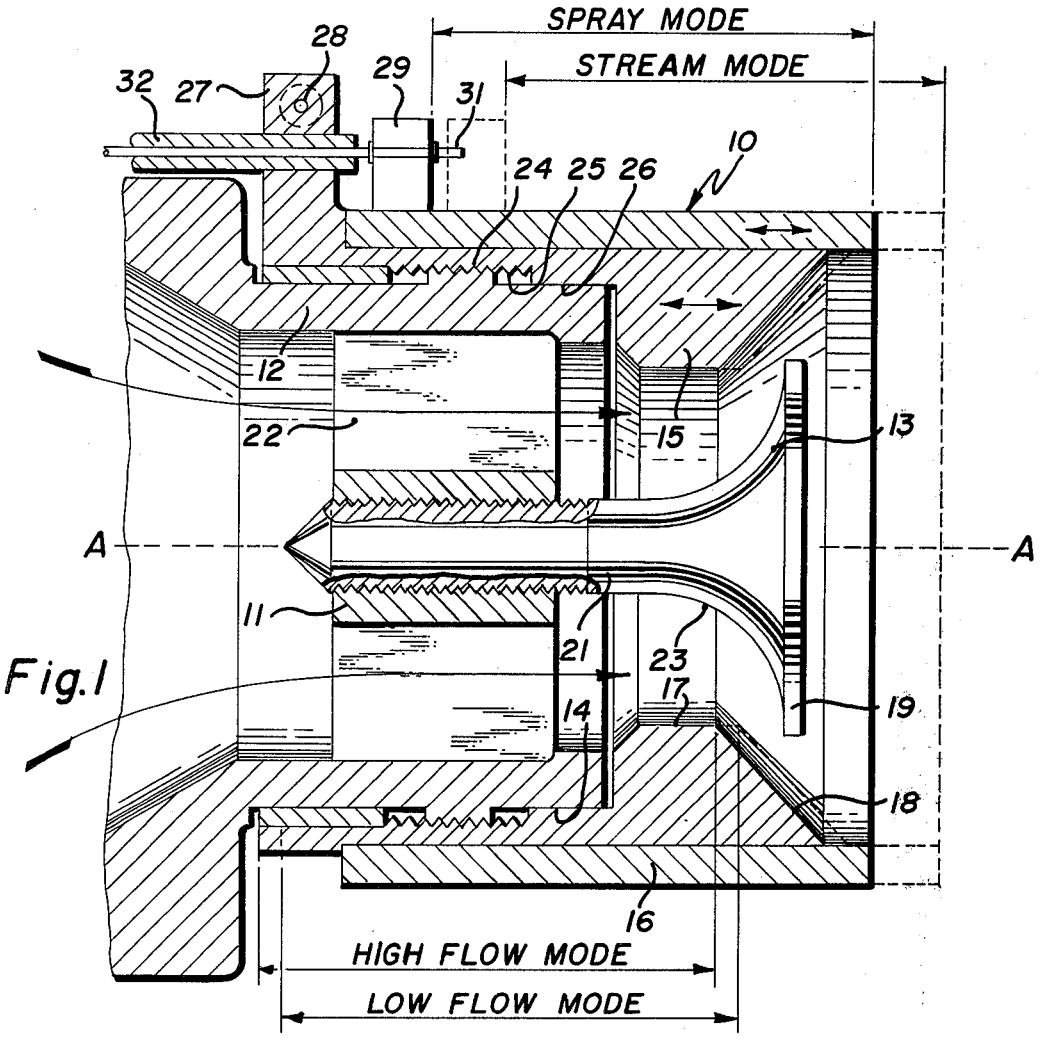
FIG. 1 is a vertical sectional view of a nozzle incorporating the principles of the present invention.

Referring first to FIG. 1, wherein are best shown the general features of the invention, the nozzle, indicated generally by the reference numeral 10, is shown as having a fixed assembly 11, including a tubular housing 12 and a button 13. The assembly has a cylindrical surface 14 and the housing and the button are concentric with the axis of that cylindrical surface. A first sleeve 15 is concentric with and slidable on the cylindrical surface 14 and is movable relative to the housing 12 to control a control gap "d". A second sleeve 16 is mounted concentrically with the cylindrical surface 14 and is movable relative to the first sleeve and the button 13 to control spray.

Figure 2:
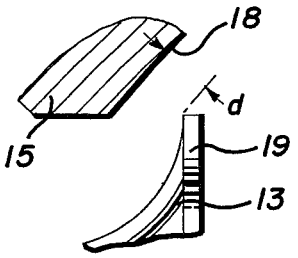
FIGS. 2 and 3 are schematic views of portions of the nozzle showing two different conditions of operation.
Figure 3:
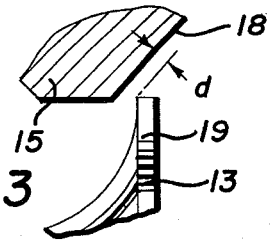

The first sleeve 15 is threadedly engaged with the housing 12 and is movable axially by rotation thereof. The control gap "d" (see FIGS. 2 and 3) exists between the first sleeve 15 and the button 13 and is adjusted by the movement of the first sleeve.

The first sleeve 15 is provided with a cylindrical bore 17 extending coaxially of the said cylindrical surface and merging at one end with a conical counterbore 18 facing toward the button 13. The control gap "d" lies between the button 13 and the surface of the counterbore 18.

The button 13 includes a thin disc 19 lying in a plane extending at a right angle to the axis of the cylindrical surface 14. The disc is joined to the housing 12 by an axial spindle 21 leading to a support frame 22 mounted in the housing. The spindle 21 flares in a smoothly curved surface 23 from a thin portion (at the frame 22) outwardly to adjacent the periphery of the disc 19. The cylindrical outer surface 14 of the housing 12 is provided with coarse, long-lead threads 24 that operatively engage similar threads 25 associated with an inner cylindrical surface 26 of the first sleeve 15.

The first sleeve 15 is provided with an outwardly-extending finger 27 that is moved transversely of the axis by a first cable 28. The second sleeve 16 is provided with an outwardly-extending finger 29 that is moved axially by a second cable 31. The second cable is slidably carried in a bushing 32 in the finger of the first sleeve.

The operation and advantages of the present invention will now be readily understood in view of the above description. Assuming that the nozzle is in the condition as shown in FIG. 1, the nozzle is set for a HIGH FLOW rate of fluid and a SPRAY MODE relative to the nature of the stream. The fluid enters at the left-hand side, passes through the frame 22 which is a spider having four abutments extending at 90° and leaving considerable space between abutments for the flow of fluid. The fluid then passes through the right-hand side of the first sleeve 12, first passing through the bore 17. The fluid, of course, flows in the annular passage that exists between the surface of the bore 17 and the curved surface 23 of the spindle 21. Eventually, the fluid passes outwardly between the surface of the counterbore 18 and the outer periphery of the disc 19 of the button 13. More specifically, the actual gap "d", shown in FIG. 2, lies between the surface of the counterbore 18 and the corner of the disc 19 which is part of the button 13. If it is desirable to change the flow to the LOW FLOW rate, it is necessary to bring the surface 18 closer to the corner of the disc 19 and, for that purpose, the cable 28 is pull carrying with it the finger 27 which rotates the first sleeve 15. The threads 24 and 25 on the housing 12 and the first sleeve 15, respectively, are of a very coarse, long-lead character, so that very slight rotation of the first sleeve produces considerably longitudinal movement of the first sleeve 15 axially. The rotation of the first sleeve 15 in this way causes the surface 18 to approach closer to the corner of the disc 19 and arrives at the position shown in dotted lines in FIG. 1 and shown in solid lines in FIG. 3 where LOW FLOW of the fluid through the nozzle is accomplished.

Similarly, in order to change the nature of the stream, it is only necessary to move the cable 31 axially and this carries the finger 29 and the second sleeve 16. In FIG. 1 the sleeve is shown in position to give a SPRAY MODE to the stream. Movement of the sleeve outwardly into the dotted position, as shown in FIG. 1, gives a STREAM MODE where the fluid after it leaves the gap "d" has the direction of its flow changed in a lesser or a greater amount.

It can be seen, then, that by use of the present invention it is possible to obtain two radically different stream flows and at the same time change the character of that flow as to whether it is in the SPRAY MODE or the STREAM MODE without difficulty. The pattern change can be accomplished while the nozzle is being operated and while fluid is flowing through the passages. The structure is inexpensive and simple and will give a long life of useful service with a minimum of maintenance. Because of its simplicity, it will work with various kinds of fluids, even fluids having a high degree of foreign matter in them.

It is obvious that minor changes may be made in the form and construction of the invention without departing from the material spirit thereof. It is not, however, desired to confine the invention to the exact form herein shown and described but it is desired to include all such as properly come within the scope claimed.

The invention having been thus described, what is claimed as new and desired to secure by Letters Patent is:

1. Nozzle for non-asipirated fire-fighting medium, comprising:

(a) a fixed assembly including a tubular housing and a button, the assembly having an outer cylindrical surface provided with threads, the housing and the button being concentric with the central longitudinal axis of the outer cylindrical surface, (b) a first sleeve having an inner cylindrical surface provided with threads that operatively engage the threads on said outer cylindrical surface to enable the first sleeve to be moved along said axis by rotation of the first sleeve about said axis to control a control gap between the first sleeve and the button, (c) a second sleeve concentric with the cylindrical surface and slidably mounted on the first sleeve for movement along said axis relative to the button to control spray, (d) first drive means for rotating the first sleeve about said axis, and (e) second drive means for sliding the second sleeve on the first sleeve along said axis.

2. Nozzle as recited in claim 1, wherein the first drive means is a first outwardly-extending finger attached to the first sleeve and a first cable attached to the first finger, and wherein the second drive means is a second outwardly-extending finger attached to the second sleeve and a second cable attached to the second finger.

3. Nozzle as recited in claim 2, wherein a bushing is mounted in the first finger and the second cable is slidably carried in the bushing.

4. Nozzle for non-aspirated fire-fighting medium, comprising:

(a) a fixed assembly including a tubular housing and a button, the assembly having an outer cylindrical surface provided with threads, the housing and the button being concentric with the axis of the cylindrical surface, (b) a first sleeve having an inner cylindrical surface provided with threads that operatively engage the threads on said outer cylindrical surface to enable the first sleeve to be movable axially relative to the housing by rotation of the first sleeve about said axis to control a control gap between the first sleeve and the button, said first sleeve being provided with an outwardly extending finger that is moved transversely of said axis by a first cable, and (c) a second sleeve concentric with the cylindrical surface and movable axially relative to the first sleeve and the button to control spray, said second sleeve being provided with an outwardly-extending finger that is moved axially by a second cable, the second cable being slidably carried in a bushing mounted in the finger of the first sleeve.

5. Nozzle as recited in claim 4, wherein the first sleeve is provided with a cylindrical bore extending coaxially of the said cylindrical surface merging at one end with a conical counterbore facing toward the button, the control gap existing between the button and the surface of the counterbore.

6. Nozzle as recited in claim 5, wherein the button includes a thin disc lying in a plane extending at a right angle to the axis, the disc being joined to the housing by an axial spindle leading to a support frame mounted in the housing.

7. Nozzle as recited in claim 6, wherein the spindle flares in a smoothly-curved surface from a thin portion outwardly to adjacent the periphery of the disc.

* * * * *